US012185809B2

(12) United States Patent
Alston

(10) Patent No.: US 12,185,809 B2
(45) Date of Patent: Jan. 7, 2025

(54) CASE FOR BOOT-LIKE FOOTWEAR

(71) Applicant: Trina S. Alston, Stonecrest, GA (US)

(72) Inventor: Trina S. Alston, Stonecrest, GA (US)

( * ) Notice: Subject to any disclaimer, the term of this patent is extended or adjusted under 35 U.S.C. 154(b) by 122 days.

(21) Appl. No.: 17/953,174

(22) Filed: Sep. 26, 2022

(65) Prior Publication Data

US 2023/0103261 A1 Mar. 30, 2023

Related U.S. Application Data

(60) Provisional application No. 63/247,815, filed on Sep. 24, 2021.

(51) Int. Cl.

| | |
|---|---|
| ***A45C 3/12*** | (2006.01) |
| ***A45C 13/10*** | (2006.01) |
| ***A45C 13/26*** | (2006.01) |

(52) U.S. Cl.

CPC ..... *A45C 3/12* (2013.01); *A45C 13/103* (2013.01); *A45C 13/26* (2013.01)

(58) Field of Classification Search

CPC ..... A45C 3/12; A45C 13/103; A45C 13/26

USPC ..... 206/8

See application file for complete search history.

(56) References Cited

U.S. PATENT DOCUMENTS

| | | | | |
|---|---|---|---|---|
| D395,752 | S * | 7/1998 | Foster | D3/289 |
| 8,910,844 | B2 * | 12/2014 | Rowe | A45F 3/042 224/655 |
| D789,214 | S * | 6/2017 | Belt | D9/704 |
| 2006/0228052 | A1 * | 10/2006 | Hess | A45C 13/26 383/14 |

OTHER PUBLICATIONS

Amazon.com: Tuffrider Classic Equestrian boot bag: Clothing, shoes & jewelry. Amazon.com: TuffRider Classic Equestrian Boot Bag: Clothing, Shoes & Jewelry. (Mar. 3, 2015b). https://a.co/d/g6BEU2T (Year: 2015).*

Amazon.com | Portable Tall Boots Storage bags|2 packs dust-proof . . . (May 6, 2021). https://www.amazon.com/Portable-Boots-Storage-Dust-proof-Travel/dp/B07VXV6V2K (Year: 2021).*

* cited by examiner

*Primary Examiner* — Robert J Hicks
*Assistant Examiner* — Sanjidul Islam
(74) *Attorney, Agent, or Firm* — Michael Drew

(57) ABSTRACT

A case for boot-like footwear 10 has a pair of complementary L-shaped compartments 20, 30. Each compartment has an elongated region 22, 32 with an upper end and a lower end. A detachable handle member 40, 50 depends from the upper end of each respective elongated region 22, 32. The lower end of each elongated region 22, 32 terminates in a bottom-loading foot region 24, 34. The foot region 24, 34 extends perpendicularly outwardly from the elongated region 22, 32. Each foot region 24, 34 has a selectively-openable bottom for insertion of a boot-like article. In an aspect, the handle members 40, 50 are selectively joinable to one another to form a conjoined handle 70.

11 Claims, 4 Drawing Sheets

CASE FOR BOOT-LIKE FOOTWEAR

RELATED APPLICATIONS

This application claims priority to U.S. Provisional Application No. 63/247,815 filed Sep. 24, 2021, the entirety of which is incorporated herein by reference.

TECHNICAL FIELD

This invention relates to apparatus for storing and transporting boot-like footwear, and, more particularly, relates to cases for boot-like footwear.

BACKGROUND OF THE INVENTION

Footwear, also known as foot apparel, is a common item worn by almost everyone. When an item of footwear is not being worn by a person, the footwear is typically placed in a location from which it can be retrieved when the user next desires to wear it. Sometimes the footwear is stored for a short period of time. Sometimes footwear is stored for longer periods of time.

Users of footwear often desire to transport footwear from one location to another. Footwear users typically want to prevent damage to their footwear while it is being stored or transported.

A boot is a type of footwear that typically has an elongated leg portion and a foot portion extending from the bottom of the leg portion. Boot-like footwear is typically larger than normal shoe-type footwear because of the elongated leg portion of the boot-type article. This larger configuration of footwear creates challenges in the storage and transport of the footwear.

Thus, it can be appreciated that there is a need to have a convenient means for storing and transporting boot-like footwear.

SUMMARY OF THE INVENTION

In an embodiment, there is disclosed a case for boot-like footwear having a pair of complementary L-shaped compartments. Each compartment has an elongated region with an upper end and a lower end. A detachable handle member depends from the upper end of each respective elongated region. The lower end of each elongated region terminates in a bottom-loading foot region. The foot region extends perpendicularly outwardly from the elongated region. The foot region has a selectively-openable bottom for insertion of a boot-like article.

In an aspect, the handles are selectively joinable to one another to form a conjoined handle.

DETAILED DESCRIPTION

Figure 1:
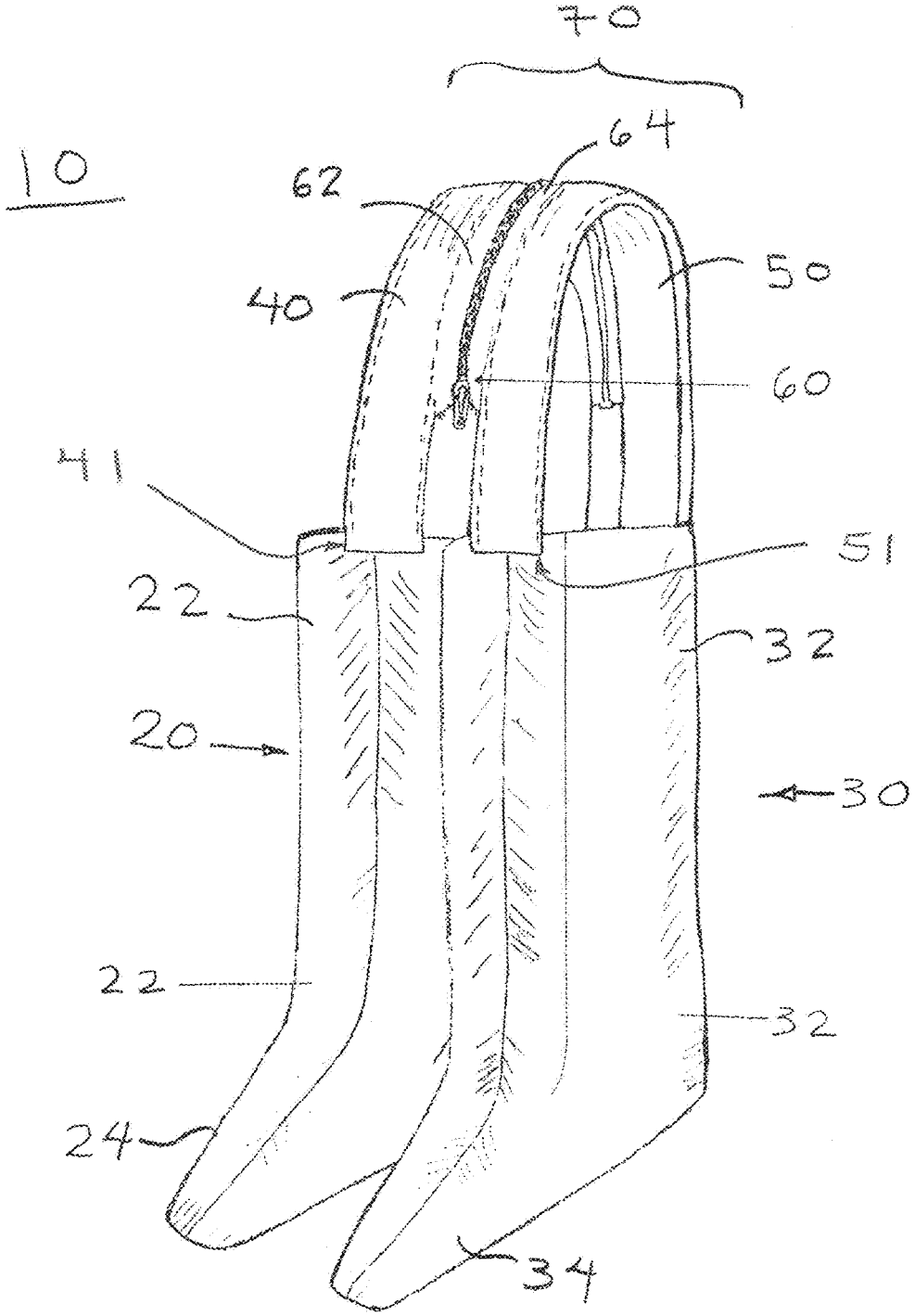
FIG. 1 is a perspective illustration of an exemplary embodiment of a case for boot-like footwear in accordance with the teachings of the present invention.

Embodiments of the present invention are described herein. The disclosed embodiments are merely exemplary of the invention that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Referring now to the drawings, wherein like numerals indicate like elements throughout the several views, the drawings illustrate certain of the various aspects of exemplary embodiments.

Referring first to FIG. 1, therein is illustrated an exemplary embodiment of a case for boot-like footwear 10 in accordance with the teachings of the present invention. The case 10 is comprised of first 20 and second 30 complementary compartments. Each compartment 20, 30 has a generally L-shaped configuration. Each L-shaped compartment 20, 30 has an elongated region 22, 32 with an upper end and a lower end, distal and spaced apart from one another, for receiving the leg portion of boot-like footwear. A first foot region 24 is formed at the lower end of the first elongated region 22. A second foot region 34 is formed at the lower end of the second elongated region 32. The first foot region 24 extends perpendicularly from the lower end of the first elongated region 22 and the second foot region 34 extends perpendicularly from the lower end of the second elongated region 32. A first handle member 40 extends from the upper end 41 of the first elongated region 22 and a second handle member 50 extends from the upper end 51 of the second elongated region 32. The first 40 and second 50 handle members are releasably joinable to one another by a handle joinder mechanism such as a handle zipper 60. In the illustrated embodiment, the handle zipper 60 is formed from first zipper member 62 and second zipper member 64. The joined first handle member 40 and second handle member 50 form a conjoined handle 70 for the case 10.

Figure 2:
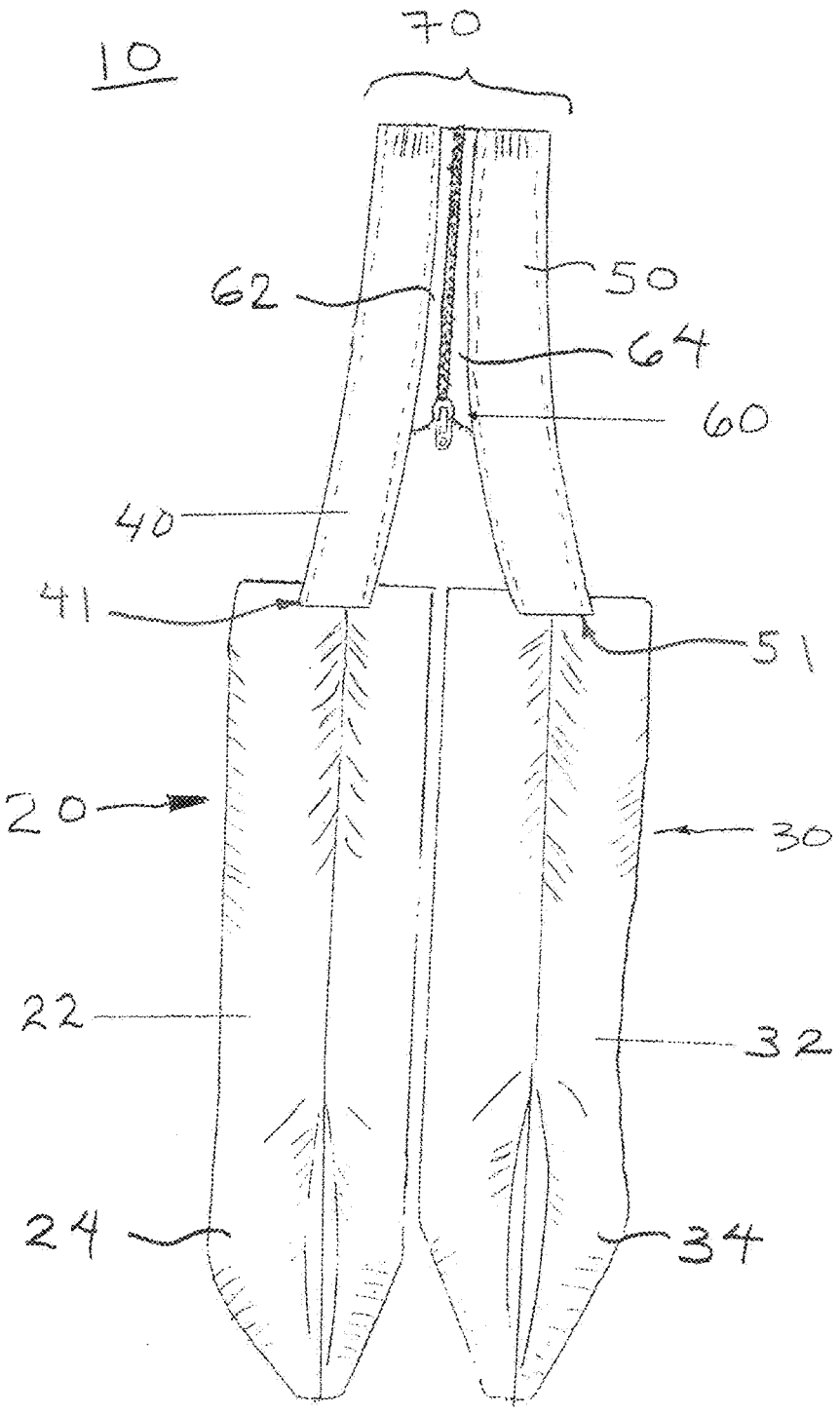
FIG. 2 is a front elevation view of the case for boot-like footwear of FIG. 1.

Referring now to FIG. 2, the features of an exemplary embodiment of a case for boot-like footwear 10 in accordance with the teachings of the present invention that are described with respect to FIG. 1 are illustrated from a front elevation vantage point. The case 10 is comprised of first 20 and second 30 complementary compartments. Each compartment 20, 30 has a generally L-shaped configuration. Each L-shaped compartment 20, 30 has an elongated region 22, 32 with an upper end and a lower end, distal and spaced apart from one another. A first foot region 24 is formed at the lower end of the first elongated region 22. A second foot region 34 is formed at the lower end of the second elongated region 32. The first foot region 24 extends perpendicularly from the lower end of the first elongated region 22 and the second foot region 34 extends perpendicularly from the lower end of the second elongated region 32. A first handle member 40 extends from the upper end 41 of the first elongated region 22 and a second handle member 50 extends from the upper end 51 of the second elongated region 32. The first 40 and second 50 handle members are releasably joinable to one another by a handle joinder mechanism such as a handle zipper 60. In the illustrated embodiment, the handle zipper 60 is formed from first zipper member 62 and second zipper member 64. The joined first handle member 40 and second handle member 50 form a conjoined handle 70 for the case 10.

Figure 3:
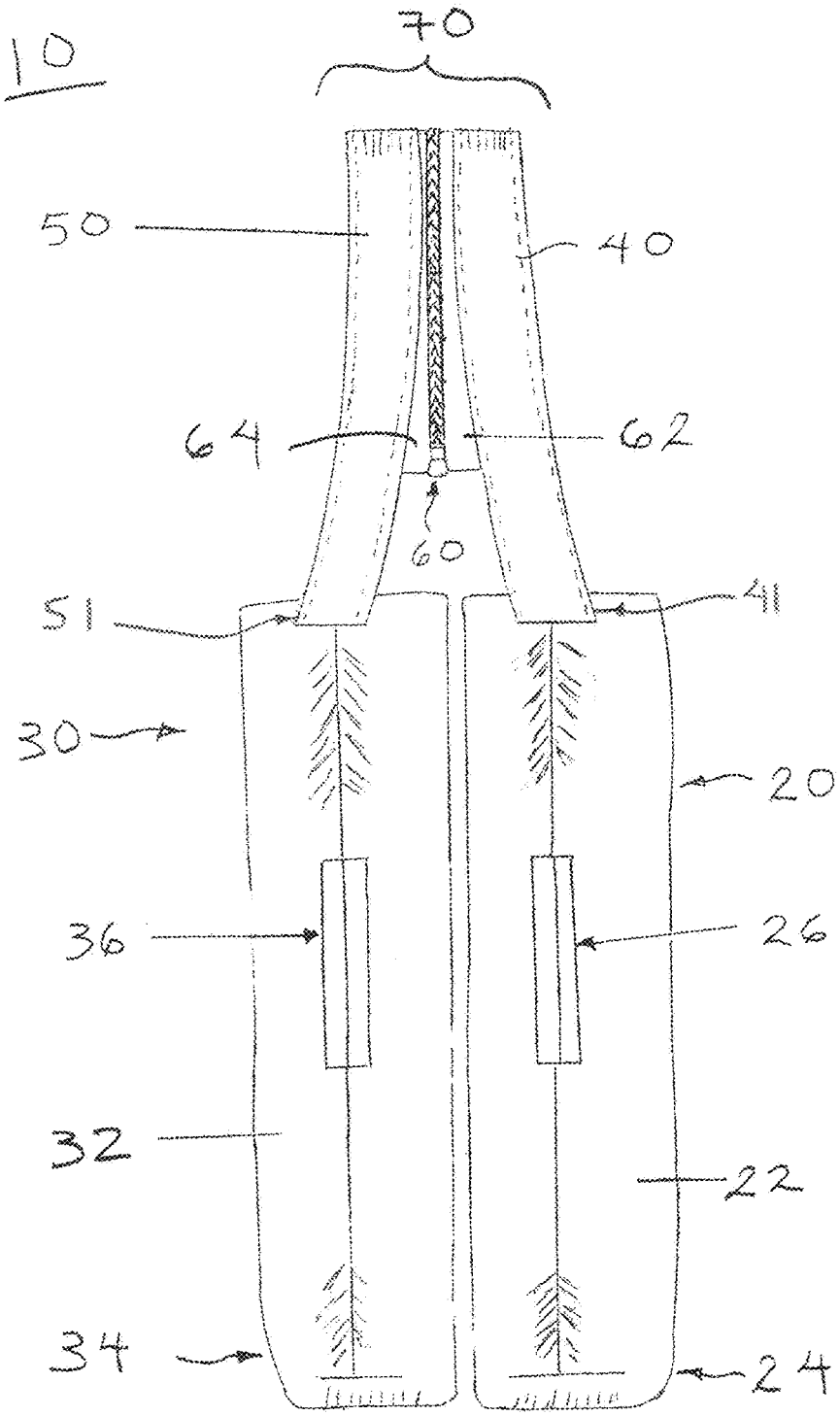
FIG. 3 a is rear elevation view of the case for boot-like footwear of FIG. 1.

Referring now to FIG. 3, many of the features of an exemplary embodiment of a case for boot-like footwear 10 in accordance with the teachings of the present invention that are described with respect to FIG. 1 are illustrated from a rear elevation vantage point. This rear vantage point shows the additional elements of a first viewing aperture 26 positioned in the rear of the first elongated region 22 of the first L-shaped compartment 20 and a second viewing aperture 36 positioned in the rear of the second elongated region 32 of the second L-shaped compartment 30. The case 10 itself is comprised of first 20 and second 30 complementary compartments. Each compartment 20, 30 has a generally L-shaped configuration. Each L-shaped compartment 20, 30 has an elongated region 22, 32 with an upper end and a lower end distal and spaced apart from one another. A first foot region 24 is formed at the lower end of the first elongated region 22. A second foot region 34 is formed at the lower end of the second elongated region 32. The first foot region 24 extends perpendicularly from the lower end of the first elongated region 22 and the second foot region 34 extends perpendicularly from the lower end of the second elongated region 32. A first handle member 40 extends from the upper end 41 of the first elongated region 22 and a second handle member 50 extends from the upper end 51 of the second elongated region 32. The first 40 and second 50 handle members are releasably joinable to one another by a handle joinder mechanism such as a handle zipper 60. In the illustrated embodiment, the handle zipper 60 is formed from first zipper member 62 and second zipper member 64. The joined first handle member 40 and second handle member 50 form a conjoined handle 70 for the case 10.

Figure 4:
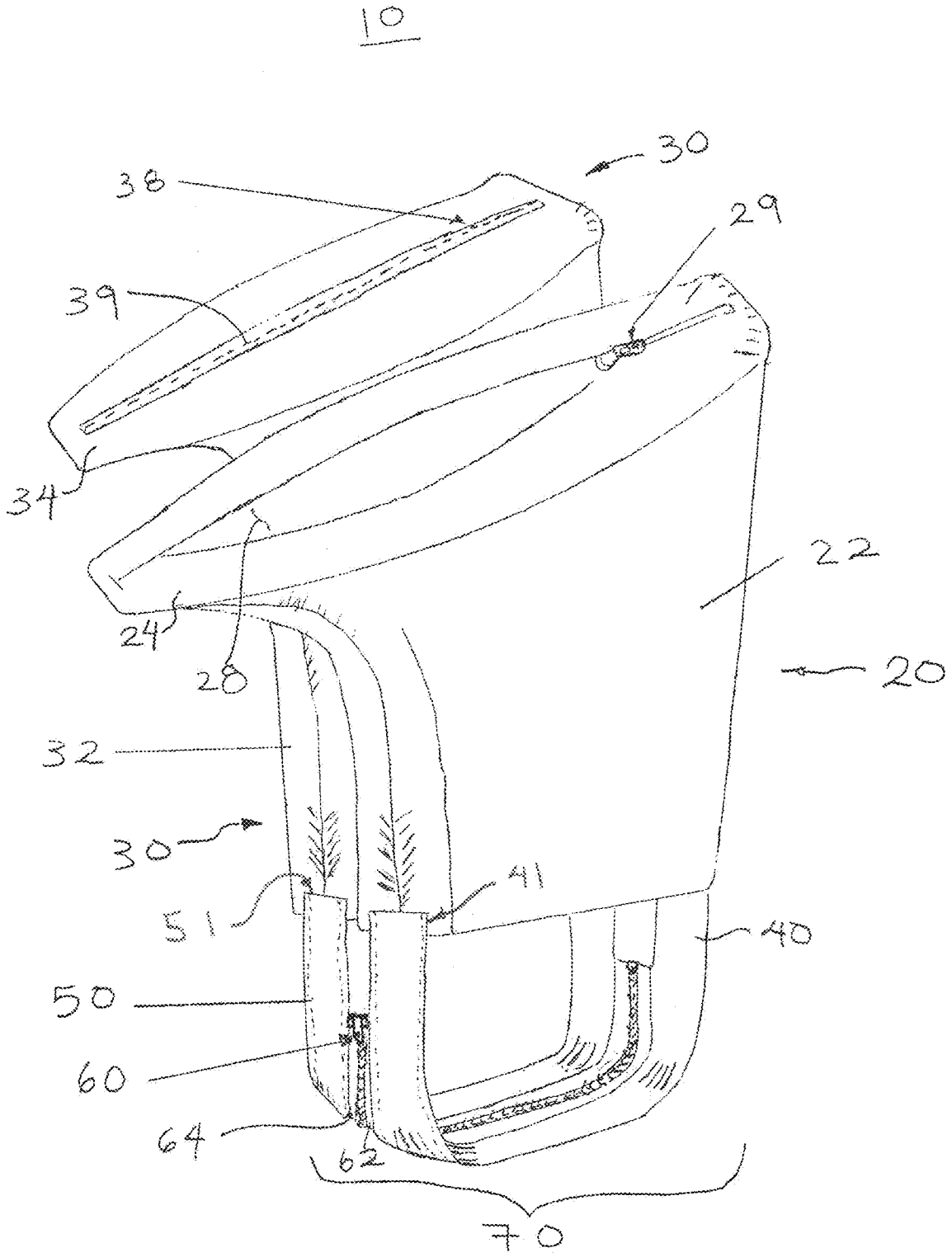
FIG. 4 is a perspective illustration of the case for boot-like footwear of FIG. 1 showing the case in an inverted condition with the bottom-most portion on top.

Referring now to FIG. 4, many of the features of an exemplary embodiment of a case for boot-like footwear 10 in accordance with the teachings of the present invention that are described with respect to FIG. 1 are illustrated from a bottom perspective vantage point. In this view, the case 10 has been flipped upside down to reveal the additional features of a first bottom opening 28 disposed in a lower portion of the first foot region 24 and a second bottom opening 38 disposed in a lower portion of the second foot region 34. A boot-like article is insertable through the first bottom opening 28 and the second bottom opening 38 when each bottom opening 28, 38 is in an open condition. The first and second bottom openings 28, 38 are releasably sealable such that after an article of footwear has been inserted within the respective first and second compartments 20, 30 the articles are retained therein. A releasable bottom closure mechanism such as a foot-bottom-closure zipper 29, 39, releasably seals each respective first and second bottom opening 28, 38. As described with respect to the previously discussed views, the case 10 itself is comprised of first 20 and second 30 complementary compartments. Each compartment 20, 30 has a generally L-shaped configuration. Each L-shaped compartment 20, 30 has an elongated region 22, 32 with an upper end and a lower end distal and spaced apart from one another. A first foot region 24 is formed at the lower end of the first elongated region 22. A second foot region 34 is formed at the lower end of the second elongated region 32. The first foot region 24 extends perpendicularly from the lower end of the first elongated region 22 and the second foot region 34 extends perpendicularly from the lower end of the second elongated region 32. A first handle member 40 extends from the upper end 41 of the first elongated region 22 and a second handle member 50 extends from the upper end 51 of the second elongated region 32. The first 40 and second 50 handle members are releasably joinable by a handle joinder mechanism such as a handle zipper 60. In the illustrated embodiment, the handle zipper 60 is formed from first zipper member 62 and second zipper member 64. The joined first handle member 40 and second handle member 50 form a conjoined handle 70 for the case 10.

The L-shape of the complementary compartments 20, 30 provides a means for securing and immobilizing footwear during storage and transport. The invention teaches that the elongated regions 22, 32 may be either open or closed at the top. However, a closed top provides a more secured and sealed package for footwear. The invention teaches that the elongated regions may be constructed as being collapsible before insertion of footwear, and openable to a tubular condition, or may be constructed as fixedly tubular.

The bottom openings 28, 38 of the foot regions 24, 34 facilitate insertion and removable of footwear with respect to the case 10. Boot-like footwear can be easily and quickly placed into and removed from the case 10 through the bottom openings 28, 38. The bottom-loaded foot region 24, 34 facilitates efficient, easy insertion and removal of footwear while also providing optimum, undisturbed and contiguous interior storage space. Possibly damaging or otherwise undesirable contact with the footwear is essentially eliminated except at the bottom of the sole of the footwear.

The invention contemplates and teaches that various configurations of handle members 40, 50 may be employed. However, U-shaped, strap-like handle members 40, 50 removably attached at diametrically opposed sides 41, 51 of the respective elongated regions 22, 32 as shown in the exemplary embodiment illustrated are simple and effective for supporting the compartments 20, 30. Although strap-like handles can be oriented in several different orientations, the invention contemplates and teaches orientation of the strap handle member 40, 50 in parallel alignment with the outwardly and perpendicularly extending foot region 24, 34. This alignment facilitates easy and efficient individual or joint transport of the compartments 20, 30. The strap-like configuration and parallel alignment with the foot regions also facilitates joining the handle members 40, 50 to form a conjoined handle 70. Use of a strap-like handle in parallel alignment with each foot region 24, 34 facilitates storage and transport of L-shaped compartments 20, 30 in mirror-like alignment with respect to one another as illustrated in FIGS. 1-4. The invention contemplates and teaches that each handle member 40, 50 is detachable from 41, 51 its respective elongated region 22, 32. Removal of the handle members 40, 50 facilitates storage or transport of the compartments 20, 30 in situations or environments where handles are not desired. Removability of the handle members 40, 50 can be achieved through known means including but not limited to hook and loop fasteners such as the Velcro brand of such fasteners.

The invention provides a case 10 for protecting, storing and transporting many types of boot-like footwear including but not limited to dress boots, casual boots, rain boots, motorcycle boots, western boots, outdoor boots, hunting boots, service industry boots, work boots, short to tall boots, flat boots, booties and high-heel boots. The invention facilitates protection of boot-like footwear from many types of damage including but not limited to scuffs, scratches, or scrapes.

The invention provides a means for storing and transporting a single article of footwear, or storing and transporting two articles of footwear as a conjoined pair. The case 10 taught by the invention is capable of being placed in a stationary location, or in luggage or other moveable enclosures.

The handle members 40, 50 help facilitate both storage and transport of the compartments 20, 30 individually and the case 10 as a whole. The case 10 as a whole, as well as its individual compartments 20, 30, can easily be grasped by a user by means of the handle members 40, 50 or the conjoined handle 70. The case 10 helps facilitate several non-traditional means of storage and transport. For example, during transport a pair of boots can be carried on the shoulder of a user wherein the user slips his or her arm through the conjoined handle 70 to place the case 10 on his or her shoulder, thus leaving both hands free. The invention contemplates and teaches that the case 10 can be placed upon hangers in closets or on a door hook through use of the handle members 40, 50.

The viewing apertures 26, 36 provide windows that enable a user to easily identify the contents of the case 10. The invention teaches that the viewing apertures 26, 36 may be made selectively closeable so as to obscure the contents of the compartments 20, 30 when desired. Various fastening structures such as flaps may be used in this regard. The invention further teaches that the viewing apertures 26, 36 may be covered with transparent, protective material such as plastic.

The compartments 20, 30 and handle members 40, 50 may be made from several different types of material that can be formed and manufactured into the configurations specified for the invention. Suitable types of material include but are not limited to leather, plastic, durable fabric and textiles. The interior of the compartments 20, 30 and the underside of the handle members 40, 50 may be lined with soft, protective material that protects enclosed footwear in the compartments 20, 30 and provides a cushioned surface for grasping the underside of the handle members 40, 50.

Many variations and modifications may be made to the above-described embodiments without departing from the scope of the claims. For example, releasable joinder mechanisms include not only zippers but Velcro-type fasteners, snap-type fasteners, buttons, and buckles. As another example of a variation taught by this disclosure of the invention, the handle members 40, 50 can be releasably attached to the respective elongated regions 22, 32, thus making the handle members 40, 50 and conjoined handle 70 selectively attachable.

All such modifications, combinations, and variations are included herein by the scope of this disclosure and the following claims.

The invention claimed is:

1. A case for boot-like footwear comprising:

a first L-shaped compartment and a second L-shaped compartment distinct from said first L-shaped compartment;

said first L-shaped compartment having a first elongated region and said second L-shaped compartment having a second elongated region, each said elongated region adapted for receiving a leg portion of an item of boot-like footwear, each said elongated region having an upper end and a lower end distal one another, and each said elongated region having a foot region extending perpendicularly from said lower end thereof adapted for receiving and retaining a foot portion of boot-like footwear, each said foot region having a closable bottom opening positionable between an open condition wherein the item of footwear is insertable into an interior of said compartment and a closed condition wherein the item of footwear is retained within said interior of said compartment; and further comprising first handle member depending from said upper end of said elongated region of said first compartment and second handle member depending from said upper end of said elongated region of said second compartment, each in parallel alignment with respect to a respective said foot region, wherein said first handle member and said second handle member are selectively joinable to one another so as to form a conjoined handle adapted for maintaining said first L-shaped compartment and said second L-shaped compartment, and respective said foot regions thereof, adjacent and in parallel alignment with respect to one another.

2. The case for boot-like footwear of claim 1, wherein each said closable bottom opening has a closure mechanism for selectively opening and closing said bottom opening.

3. The case for boot-like footwear of claim 2, said closure mechanism comprising a foot-bottom-closure zipper.

4. The case for boot-like footwear of claim 1, further comprising a handle-joinder mechanism for selectively joining said first handle member and said second handle member to one another.

5. The case for boot-like footwear of claim 4, wherein said handle-joinder mechanism comprises a handle zipper.

6. The case for boot-like footwear of claim 1, wherein said first handle member releasably depends from said upper end of said elongated region of said first compartment and said second handle member is releasably depends from said upper end of said elongated region of said second compartment.

7. The case for boot-like footwear of claim 1, wherein said first handle member comprises a first strap member and said second handle member comprises a second strap member.

8. The case for boot-like footwear of claim 7, wherein opposing ends of said first strap member depend from said upper end of said elongated region of said first compartment at diametrically opposed positions thereof and opposing ends of said second strap member depend from said upper end of said elongated region of said second compartment at diametrically opposed positions thereof.

9. The case for boot-like footwear of claim 7, wherein opposing ends of said first strap member releasably depend from said upper end of said elongated region of said first compartment at diametrically opposed positions thereof and opposing ends of said second strap member releasably depend from said upper end of said elongated region of said second compartment at diametrically opposed positions thereof.

10. The case for boot-like footwear of claim 1, further comprising a viewing opening disposed in each respective said elongated region.

11. The case for boot-like footwear of claim 10, wherein said viewing opening is disposed in a rear portion of said elongated region.

* * * * *